US005558833A

United States Patent [19]

Zamojski

[11] Patent Number: 5,558,833

[45] Date of Patent: Sep. 24, 1996

[54] SILVER ALLOY

[76] Inventor: Marek R. Zamojski, 11 Reade St., North Providence, R.I. 02904

[21] Appl. No.: 489,123

[22] Filed: Jun. 9, 1995

[51] Int. Cl.[6] ..... C22C 5/06

[52] U.S. Cl. ..... 420/502; 148/430

[58] Field of Search ..... 148/405, 430; 420/502; C22C 5/06, 5/08

[56] References Cited

U.S. PATENT DOCUMENTS

| | | | |
|---|---|---|---|
| 2,157,933 | 5/1939 | Hensel | 420/501 |
| 2,161,253 | 6/1939 | Hensel et al. . | |
| 4,030,918 | 6/1977 | Sung et al. . | |
| 4,170,471 | 10/1979 | Balley . | |
| 4,409,181 | 10/1983 | Coad . | |
| 4,883,745 | 11/1989 | Mizuhara . | |
| 4,948,557 | 8/1990 | Davitz . | |
| 4,980,243 | 12/1990 | Malikowski et al. . | |
| 4,992,297 | 2/1991 | van der Zel . | |
| 5,021,214 | 6/1991 | Sasaki et al. . | |

FOREIGN PATENT DOCUMENTS

| | | | |
|---|---|---|---|
| 50-026092 | 3/1975 | Japan . | |
| 58-110639 | 7/1983 | Japan . | |
| 5001340 | 1/1993 | Japan | C22C 5/06 |
| 6-220555 | 8/1994 | Japan | C22C 5/08 |

*Primary Examiner*—David A. Simmons
*Assistant Examiner*—Margery S. Phipps
*Attorney, Agent, or Firm*—Salter & Michaelson

[57] ABSTRACT

A silver alloy having a reduced porosity surface after it has been cast in a mold is disclosed. The silver alloy consists of silver in a range from 92.50 to 99.00 percent by weight, indium in a range from 0.01 to 7.40 percent by weight, molybdenum in a range from 0.001 to 0.10 percent by weight, and the balance of copper. In one embodiment, the silver alloy consists of 93.50 percent by weight silver, 1.00 percent by weight indium, 0.05 percent by weight molybdenum, and the balance copper. A process for casting the silver alloy is also disclosed.

1 Claim, No Drawings

SILVER ALLOY

BACKGROUND AND SUMMARY OF THE INVENTION

This invention relates generally to silver alloys and more particularly to an improved silver alloy having a reduced porosity finish, and to an improved process of casting ornamental articles from such a silver alloy.

When casting articles, such as fine jewelry, it is important that the article being cast has a non-porous finish which is suitable for polishing. Along these lines, cast silver alloy articles having a reduced porosity finish also have a lower rejection rate than cast articles having a porous finish. Example 1 of the examples described below outlines the qualities and characteristics of a traditional silver/copper alloy (otherwise referred to as "sterling silver") in the areas of surface quality, structure quality and polishing capability. As discussed, while having a satisfactory structure quality and polishing capability, articles cast with this alloy tend to have an unsatisfactory surface quality with evidence of extreme porosity and microporosity occurring in articles sampled. The rejection rate of the articles associated with this prior art alloy is generally between ten and twenty percent which significantly increases the cost of the articles produced thereby lessening the manufacturer's ability to compete in the market place.

Reference should be made to the following U.S. Patents which disclose alloys in the same general field of the present invention: U.S. Pat. Nos. 2,157,933 (Hensel et al.); 2,161,253 (Hensel et al.): 4,030,918 (Sung et al.); 4,170,471 (Bailey); 4,409,181 (Coad); 4,883,745 (Mizuhara); 4,948,557 (Davitz); 4,980,243 (Malikowski et al.); 4,992,297 (van der Zel); and 5,021,214 (Sasaki et al.). Particular reference should be made to the patent to Coad which discloses, as one of its many embodiments, a brazing material consisting of from about 50% to about 99% by weight of a brazing alloy consisting of 25% to about 40% by weight of copper, from 0 to about 25% by weight indium, and the balance silver, and from about 1% to about 50% by weight of molybdenum. It will be shown that the silver alloy of the present invention differs significantly from Coad's brazing material in that it is silver-based and is suitable for casting fine silver jewelry having a substantially non-porous finish suitable for polishing.

The present invention has particular application to a silver alloy having a reduced porosity surface after it has been cast in a mold. Generally, the silver alloy consists of silver in a range from 92.50 to 99.00 percent by weight, indium in a range from 0.01 to 7.40 percent by weight, molybdenum in a range from 0.001 to 0.10 percent by weight, and the balance of copper. Preferably, the silver alloy consists of 93.50 percent by weight silver, 1.00 percent by weight indium, 0.05 percent by weight molybdenum, and the balance copper. Anti oxidants like zinc and silicon may also be added to the alloy to further reduce the porosity of the surface of the cast alloy.

A process for casting the silver alloy comprises the steps of: (a) providing a container suitable for melting and casting molten metal; (b) depositing in the container, elements of a silver alloy consisting of silver in a range from 92.50 to 99.00 percent by weight, indium in a range from 0.01 to 7.40 percent by weight, molybdenum in a range from 0.001 to 0.10 percent by weight, and the balance of copper; (c) heating the container to a temperature between 2600 to 2800 degrees Fahrenheit until the elements comprising the silver alloy substantially melt and are approximately at saturation level; (d) providing a mold; and (e) casting the melted silver alloy in the mold at a temperature around 2200 degrees Fahrenheit.

Accordingly, among the several objects of the present invention are the provision of an improved silver alloy having a reduced porosity finish; the provision of such an alloy which is suitable for polishing; the provision of such an alloy having increased strength characteristics; the provision of such an alloy which produces cast articles having a low rejection rate; and the provision of such an alloy which is strong, durable and suitable for mounting gems thereon.

Also among the several objects of the present invention are the process for casting the silver alloy capable of producing cast articles having a reduced porosity finish suitable for polishing; and the provision of such a process which produces cast articles having a low rejection rate.

Other objects, features and advantages of the invention shall become apparent as the description thereof proceeds.

DETAILED DESCRIPTION OF THE PREFERRED EMBODIMENTS

As described briefly above, the present invention is directed to a silver alloy which, when cast, has a reduced porosity finish which is suitable for polishing and has increased strength characteristics. The silver alloy in accordance with the present invention consist of silver in a range from 92.50 to 99.00 percent by weight, indium in a range from 0.01 to 7.40 percent by weight, molybdenum in a range from 0.001 to 0.10 percent by weight, and the balance of copper (i.e., 0 to 7.489 percent by weight). As will be noted below, this combination of elements produces a silver alloy which is especially suited for casting fine silver jewelry having substantially a non-porous finish.

Preferably, as will be evident in the discussions of the previously noted examples, the silver alloy consist of about 93.50 percent by weight silver, about 1.00 percent by weight indium, about 0.05 percent by weight molybdenum, and the balance copper (i.e., about 5.45 percent by weight). The superiority of this preferable composition is described below.

Of all the elements of the silver alloy, Indium melts first (i.e., at 332° F.) and forms a layer over the solid silver, copper and molybdenum for preventing oxidation of the silver during the melting process. The Indium also makes the cast silver alloy article more malleable so that it may be worked when in its solid state. This enables the jeweler to set a gem with greater ease since the prongs which secure the gem to the ring are more malleable.

Although the examples discussed below each disclose an alloy containing approximately 0.01 percent by weight molybdenum, it is believed that a greater amount of molybdenum, approaching a saturation level (e.g., about 0.05 percent by weight), produces a superior cast article. Since the molybdenum never completely melts (i.e., it has a melting temperature of 4657° F.), it forms an outer layer about the cast article so as to prevent oxidation on its outer surface. It has also been discovered that the molybdenum acts as a catalyst in that it influences the mixing of the silver, copper and indium thereby forming a more consistent alloy.

In another preferred embodiment of the present invention, the silver alloy further consists of zinc in a range from 0.10 to 3.00 percent by weight. In this preferred embodiment, zinc has also been found to further assist in the prevention of porosity of the outer surface of the cast article.

In yet another preferred embodiment of the present invention, the silver alloy further consists of silicon in a range from 0.001 to 0.500 percent by weight. Like zinc, silicon has been found to assist in achieving a substantially non-porous finish. The silicon may or may not be combined with the zinc depending upon the type of casting required.

In creating the composition as described, it is important to recognize that the internal crystal lattice structure of copper and silver are face centered cubic, whereas the crystal lattice structure of molybdenum is body centered cubic and Indium is face centered tetragonal. Since the crystals of copper and silver, when combined, tend to create voids therebetween, the crystals of the Indium additive act to fill the voids to form a firm mechanical combination. The crystal lattice of the molybdenum crystals when combined with silver, copper and indium crystals acts to produce a stronger and longer lasting structure that effectively resists deterioration.

The process of the present invention of casting the silver alloy preferably utilizes the lost wax process which is well-known in the art of casting fine jewelry. Particularly, the process comprises providing a container (e.g., a crucible) suitable for melting and casting molten metal. The aforementioned silver alloy is then deposited in the crucible, the alloy consisting of silver in a range from 92.50 to 99.00 percent by weight, indium in a range from 0.10 to 7.40 percent by weight, molybdenum in a range from 0.001 to 0.10 percent by weight, and the balance of copper. More specifically, the step of depositing the elements of the silver alloy into the crucible includes the step of layering within the crucible, from the bottom of the crucible to the top thereof, molybdenum chips, indium pellets, copper pellets, and silver pellets, respectively. This layering step assists in achieving the proper mixture of the elements.

Next, the crucible is heated to a temperature between 2600° F. to 2800° F. until the elements comprising the silver alloy substantially melt and are approximately at saturation level. More specifically, during the step of heating the crucible, since Indium melts first, a layer of indium is melted over the other elements of the silver alloy (i.e., silver, copper and molybdenum) before the other elements reach their respective melting temperatures. The layer of indium penetrates into the crevices defined by the molybdenum chips and copper and silver pellets for substantially preventing the silver from oxidizing when heating the crucible and melting the elements. This has been found to assist in reducing the porosity of the outer surface of the cast article. As noted above, the molybdenum never reaches its melting temperature, but is sufficiently mixed with the other melted elements so that it acts as a catalyst and produces an outer layer over the cast article after it has been cast.

Prior to casting the silver alloy of the subject invention, a mold having a predetermined design as created by an original work is produced, the mold being formed by shaping a positive wax member that defines the article being cast. Thereafter a plurality of the wax members are formed into a wax tree. The wax members and tree are then placed into a stainless steel tube, sometimes referred to as a "flask", which is filled with a plaster of paris and silicon mixture. The flask is then heated in an oven to approximately 1350° F. to harden the mixture and to melt the wax for the removal thereof, the flask thereafter being cooled slowly in the oven to cure the mold. The removal of the wax from the mold forms the mold cavity of the investment mold. This so-called "lost wax" process of manufacturing the mold is well-known in the art of investment casting of which a person skilled in the art is readily familiar.

After forming the mold, the silver alloy of the subject invention is then poured or cast in the mold at a temperature around 2200° F. in such a manner that the molten silver alloy enters the cavities in the mold thereby forming the articles. As mentioned briefly above, the molybdenum forms an outer layer about the cast article so as to prevent oxidation on its outer surface. The casting is then cooled for approximately ten to fifteen minutes after which the articles are sufficiently hard so as to remove the mold therefrom. The mold may be removed from the cast articles by any suitable method known in the art.

The articles are then removed from the tree (e.g., by cutting) and polished by known polishing methods. It is to be understood that the layer of molybdenum protects the outer surface of the cast article so that the article is protected from oxidation in case there is a long period of delay between casting and polishing. The layer of molybdenum is removed by polishing the outer surface of the article.

An example of a known prior art silver alloy is illustrated in the following analysis wherein the results as obtained are unacceptable for the commercial production of quality articles. The indicated percentages of the materials are by weight.

EXAMPLE 1

Silver (Ag): 92.5%
Copper (Cu): 7.5%
Casting Temperature: 1922° F. to 2192° F.
Surface Quality: unsatisfactory
Structure Quality: satisfactory
Polishing Capability: satisfactory to very good
Overall Comments: evidence of extreme porosity and microporosity in samples The silver alloy of the present invention is best described by way of the following examples wherein percentage of material is by weight and the consistency of the composition is varied:

EXAMPLE 2

Silver (Ag): 93.00%
Copper (Cu): 4.99%
Indium (In): 1.00%
Molybdenum (Mo): 0.01%
Cadmium (Cd): 1.00%
Casting Temperature: 1922° F.
Surface Quality: unsatisfactory
Structure Quality: good
Polishing Capability: very good
Overall Comments: poor surface quality

EXAMPLE 3

Silver (Ag): 93.00%
Copper (Cu): 4.99%
Indium (In): 1.00%
Molybdenum (Mo): 0.01%
Zinc (Zn): 1.00%
Casting Temperature: 1922° F. to 2192° F.
Surface Quality: satisfactory
Structure Quality: good
Polishing Capability: very good
Overall Comments: zinc causes the metal to be somewhat unstable; however, acceptable surface quality

EXAMPLE 4

Silver (Ag): 92.50%
Copper (Cu): 6.49 %
Indium (In): 1.00%
Molybdenum (Mo): 0.01%
Flask Temperature: 1742° F.
Casting Temperature: 1922° F. to 2282° F.
Surface Quality: good to very good
Structure Quality: satisfactory to good
Polishing Capability: good to very good
Overall Comments: casting temperature between 2102° F. to 2192° F. produces best results

EXAMPLE 5

Silver (Ag): 92.50%
Copper (Cu): 6.49%
Indium (In): 1.00%
Molybdenum (Mo): 0.01%
Flask Temperature: 1922° F.
Casting Temperature: 2012° F. to 2282° F.
Surface Quality: satisfactory to very good
Structure Quality: very good
Polishing Capability: very good
Overall Comments: produces very good results; 2282° F. casting temperature too hot

EXAMPLE 6

Silver (Ag): 92.50%
Copper (Cu): 6.49%
Indium (In): 1.00%
Molybdenum (Mo): 0.01%
Flask Temperature: 2012° F.
Casting Temperature: 1922° F. to 2282° F.
Surface Quality: satisfactory to very good
Structure Quality: very good
Polishing Capability: very good
Overall Comments: best results achieved at 1922° F. to 2012° F. casting temperatures

EXAMPLE 7

Silver (Ag): 93.50%
Copper (Cu): 5.49 %
Indium (In): 1.00%
Molybdenum (Mo): 0.01%
Casting Temperature: 2012° F. to 2192° F.
Surface Quality: very good
Structure Quality: very good, but soft
Polishing Capability: very good
Overall Comments: very good results, but too soft for filigree applications

EXAMPLE 8

Silver (Ag): 93.00%
Copper (Cu): 4.99%
Indium (In): 2.00%
Molybdenum (Mo): 0.01%
Flask Temperature: 1742° F.
Casting Temperature: 1922° F. to 2192° F.
Surface Quality: good to very good
Structure Quality: good
Polishing Capability: very good
Overall Comments: suitable for only large pieces

EXAMPLE 9

Silver (Ag): 93.00%
Copper (Cu): 4.99 %
Indium (In): 2.00%
Molybdenum (Mo): 0.01%
Flask Temperature: 1832° F.
Casting Temperature: 1922° F. to 2192° F.
Surface Quality: very good
Structure Quality: good to very good
Polishing Capability: very good
Overall Comments: best results achieved at 2102° F. to 2012° F. casting temperatures

EXAMPLE 10

Silver (Ag): 93.00%
Copper (Cu): 4.99%
Indium (In): 2.00%
Molybdenum (Mo): 0.01%
Flask Temperature: 1922° F.
Casting Temperature: 1922° F. to 2192° F.
Surface Quality: very good
Structure Quality: very good
Polishing Capability: very good
Overall Comments: very good overall results

EXAMPLE 11

Silver (Ag): 93.00%
Copper (Cu): 4.99 %
Indium (In): 2.00%
Molybdenum (Mo): 0.01%
Flask Temperature: 2012° F.
Casting Temperature: 1922° F. to 2282° F.
Surface Quality: good to very good
Structure Quality: very good
Polishing Capability: very good
Overall Comments: best results achieved at 1922° F. to 2192° F. casting temperatures As described above, Example 1 represents traditional sterling silver cast pursuant to traditional casting methods. Example 2 is a silver alloy comprising cadmium (Cd) which was found to be unsatisfactory since the outer surfaces of the cast articles were porous. Examples 3–11 each illustrate acceptable silver alloy castings having an acceptable outer surface. Each of the articles cast in Examples 3–11 consists of the silver alloy of the present invention and was made according to the process of the present invention. It should be noted that with the improved porosity of the articles cast in Examples 3–11, the silver alloy of the present invention which is made according to the process of the present invention has a one to two percent rejection rate.

As this invention may embody several forms without departing from the spirit or essential characteristics thereof, the present embodiment is therefore illustrative and not restrictive, since the scope of the invention is defined by the appended claims rather than by the description preceding them, and all changes that fall within the metes and bounds of the claims or that form their functional as well as conjointly cooperative equivalents, are therefore intended to be embraced by these claims.

What is claimed is:

1. A silver alloy having a reduced porosity surface after it has been cast in a mold, said silver alloy consisting of:

silver in a range from approximately 92.50 to 93.50 percent by weight;

copper in a range from approximately 4.99 to 6.49 percent by weight;

indium in a range from approximately 1.00 to 2.00 percent by weight; and approximately 0.01 percent by weight molybdenum.

* * * * *